US007759567B2

(12) United States Patent
Marvin

(10) Patent No.: US 7,759,567 B2
(45) Date of Patent: Jul. 20, 2010

(54) SINGLE VERTEX DAMPED CABLE TAILPIECE FOR BOWED STRING INSTRUMENTS

(76) Inventor: Kevin C. Marvin, 89 Brook Dr., Burlington, VT (US) 05401

( * ) Notice: Subject to any disclaimer, the term of this patent is extended or adjusted under 35 U.S.C. 154(b) by 0 days.

(21) Appl. No.: 11/891,365

(22) Filed: Aug. 11, 2007

(65) Prior Publication Data

US 2008/0034941 A1 Feb. 14, 2008

Related U.S. Application Data

(60) Provisional application No. 60/837,404, filed on Aug. 12, 2006.

(51) Int. Cl.
*G10D 3/04* (2006.01)

(52) U.S. Cl. ..... 84/298; 84/302

(58) Field of Classification Search ..... 84/298, 84/274, 275, 302; D17/17, 21
See application file for complete search history.

(56) References Cited

U.S. PATENT DOCUMENTS

| | | | | |
|---|---|---|---|---|
| 2,688,270 | A * | 9/1954 | Steinbauer | 84/275 |
| 3,244,791 | A * | 4/1966 | Bloom et al. | 84/726 |
| 4,367,777 | A * | 1/1983 | Baker | 144/346 |
| 2004/0129127 | A1 * | 7/2004 | Mercer | 84/307 |

* cited by examiner

*Primary Examiner*—Jianchun Qin
(74) *Attorney, Agent, or Firm*—James Marc Leas

(57) ABSTRACT

One aspect of the present patent application is a musical instrument comprising a body, a bridge, a plurality of strings, a plurality of separate cables, a single cable, and a saddle. The plurality of strings extends from a first side to a second side of the bridge. Each of the plurality of strings is connected to one of the plurality of separate cables on the second side of the bridge. All of the plurality of separate cables are joined into the single cable. The single cable extends over the instrument's saddle along one path.

36 Claims, 7 Drawing Sheets

SINGLE VERTEX DAMPED CABLE TAILPIECE FOR BOWED STRING INSTRUMENTS

RELATED APPLICATIONS

This patent application is claims priority of commonly assigned U.S. Provisional Patent Application 60/837,404 "Single Vertex Damped Cable Tailpiece for Bowed String Instruments," filed Aug. 12, 2006.

FIELD

This invention generally relates to bowed string instruments. More particularly it relates to the bridge and tailpiece of these instruments.

BACKGROUND

The four members of the acoustical violin family of bowed instruments include the violin, viola, violincello and double bass. Strings of these instruments extend across a bridge to a tailpiece that provides connection to a saddle and an end pin attached to the body of the instrument. Most prior art tailpieces have included a wooden member and a cable. Strings of the instrument are attached to one side of this wooden member and two ends of the cable extend from an opposite side of the wood member across the saddle to the end pin. Previous attempts to enhance the tailpiece provided for adjustment of the string length or string tension between the bridge and wood tailpiece in order to provide fine tuning at this end of the string, as shown in such U.S. patents as U.S. Pat. No. 4,224,859 to Peter Infield, issued in 1980, U.S. Pat. No. 2,322,137 to Janch, issued in 1943 and U.S. Pat. No. 3,048,073 to Farr, issued in 1962. Other attempts have provided an adjustable saddle, providing another way to change the tension in the strings and adjust the tone. Another connected the wood tailpiece to the body of the instrument. US patent application 2004/0129127A1 by James A Mercer II, filed Aug. 18, 2003, replaces the wooden portion of the tailpiece with multiple cables, all connecting across the saddle to the end piece.

SUMMARY

One aspect of the present patent application is a musical instrument comprising a body, a bridge, a plurality of strings, a plurality of separate cables, a single cable, and a saddle. The plurality of strings extends from a first side to a second side of the bridge. Each of the plurality of strings is connected to one of the plurality of separate cables on the second side of the bridge. All of the plurality of separate cables are joined into the single cable. Exclusively a single portion of the single cable contacts the saddle.

Another aspect of the present patent application is a musical instrument comprising a body, a bridge, a plurality of strings, a saddle, and a mechanism. The plurality of strings extends across the bridge. The plurality of strings is for vibrating on a first side of the bridge. The mechanism is located on a second side of the bridge for connecting the plurality of strings to the body. The mechanism has an elasticity depending on a material property of the mechanism. Different elasticities can be selected by providing different materials for the mechanism.

DETAILED DESCRIPTION

Figure 1:
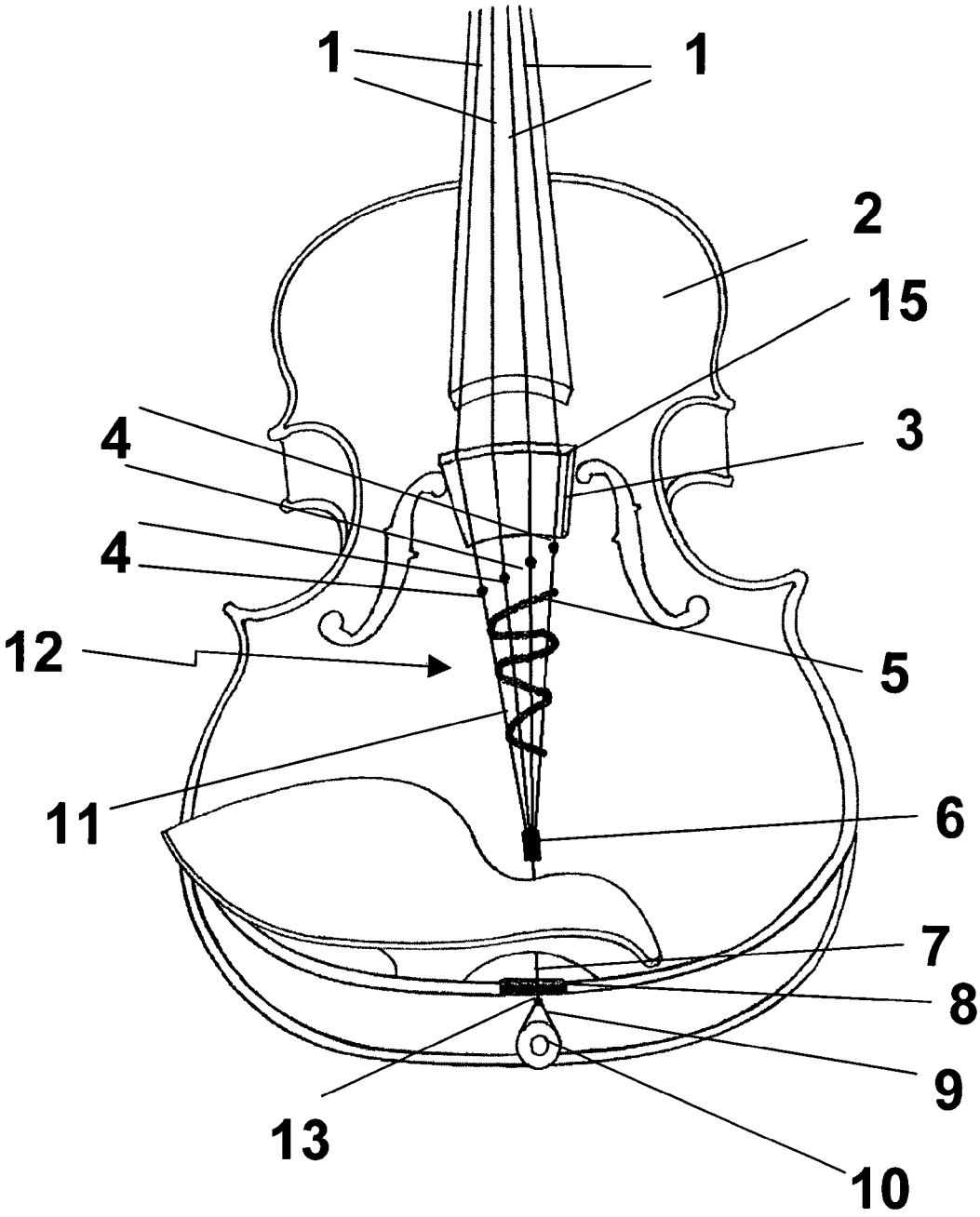
FIG. 1 is a three dimensional view of one embodiment of a stringed instrument of the present patent application showing strings connected to cables on one side of the bridge, damping of the cables, joining of the cables into a single cable, and exclusively a single portion of the single cable contacting the saddle of the instrument.
Figure 2:
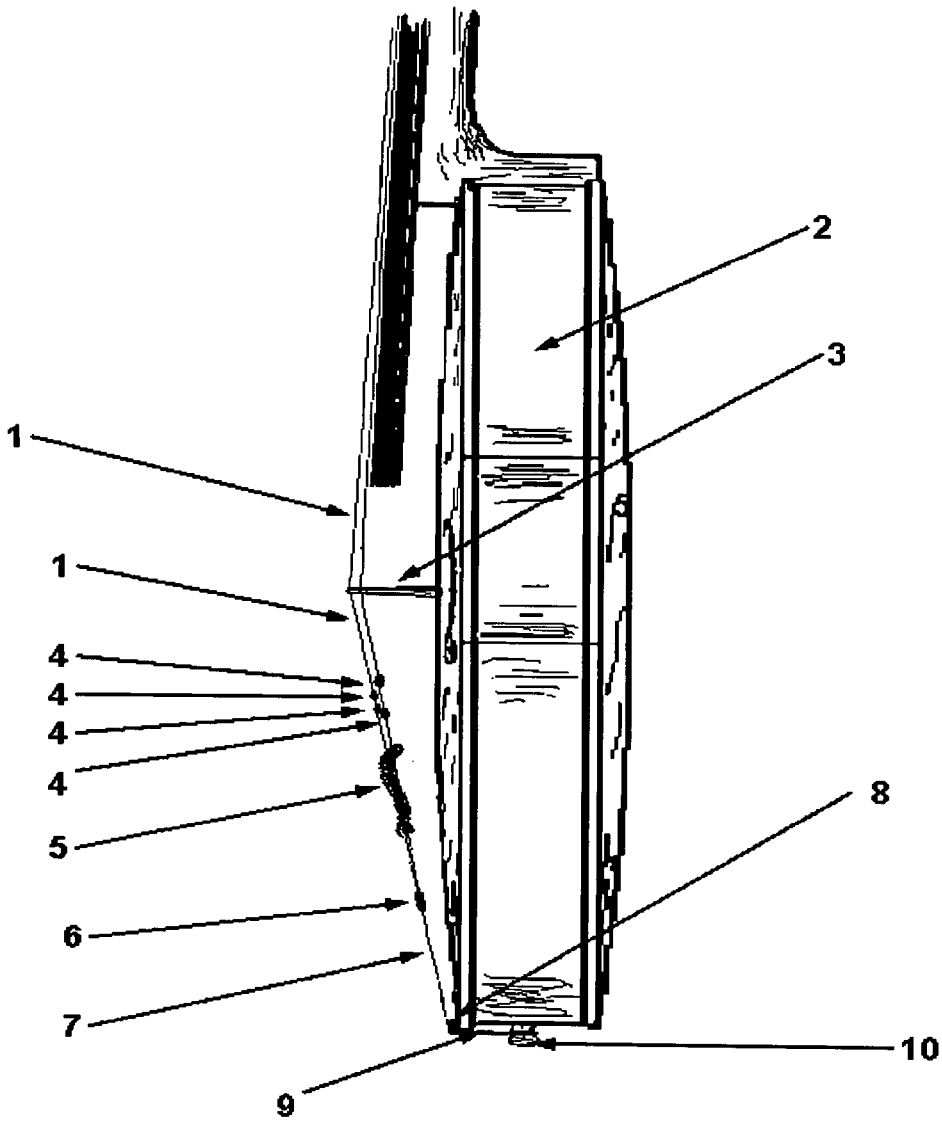
FIG. 2 is a side view of the violin of FIG. 2.

The present applicant found that he could significantly improve the sound of the instrument by eliminating a source of noise, wolf tones or unevenness of sound across the pitch range of the instrument arising from vibration of the tailpiece of the instrument. He found that eliminating the wooden mass in the tailpiece, providing a single portion of a single cable contacting the saddle, and providing damping to cables in the tailpiece he could substantially eliminate these unwanted tailpiece generated sounds. This embodiment thus provides a damped tailpiece with a single vertex.

In normal operation, the vibration of a string from bowing or plucking causes the bridge to vibrate or rock, which causes the top table of the instrument to vibrate. The vibrations of the top table amplify and enhance the sound. The present patent application increases the transfer of energy from the primary vibrations of the string through the bridge to the top table and reduces unwanted vibrations that occur from the tailpiece. This is accomplished by eliminating the wooden mass that absorbs some of the energy of vibration, by providing only one end of a cable extending across the saddle to the end pin, and by providing damping to cables in the tailpiece.

The present applicant found that eliminating the wooden mass, providing only one region of contact between a single cable and the saddle and providing damping substantially improved both energy transfer to the bridge of the instrument and the sound of the instrument. Loss of energy to the wooden mass was avoided, increasing energy transfer to the bridge. The single region of contact at the saddle freed the bridge from constraints imposed by multiple cable contacts with the saddle found in the prior art schemes. Damping further reduced unwanted vibration in the tailpiece. With these improvements he found that the undesirable sounds from the tailpiece were sharply reduced and the desired sound from the primary vibration of the strings in the fingerboard region on the opposite side of the bridge from the tailpiece was enhanced.

Eliminating the wooden mass reduces the mass of the tailpiece and reduces the energy that goes into vibrating that mass. The lightweight cable materials substituted for the wooden mass significantly reduce the mass of the tailpiece. The muting effect found with the heavier traditional wooden tailpiece was thus avoided.

The present applicant also found that by replacing the wooden member with cables he could provide a way to adjust the elasticity or stretch of the cables in the tailpiece, improving the sound of the instrument as well as the softness or feel of the strings under the player's fingers. The traditional tailpiece made of wood has very little elasticity. By replacing the wooden tailpiece with cables, the present applicant found that he could provide the player with the ability to select from among several elasticities by choosing cables fabricated of different cable materials or having different thickness or gauge of the cable material. Cable materials that can be used include those fabricated of nylon, steel, and composite materials. Thus, the present applicant was able to also provide a way to both optimize sound and adjust the softness or "feel" of the strings when being played.

The traditional use of two ends of a cable extending over the saddle to the endpin in two separate paths stabilized the bridge and inhibited the bridge's vibrations. The present applicant found that providing only a single cable end passing over the saddle reduces this constraint on bridge movement and allows for more uninhibited vibration of the bridge. In this case the cable extends over the instrument's saddle along one path. Thus, one embodiment of the present application provides only one end of a cable extending across the saddle, eliminating the constraint on bridge motion that was previously provided by two or more regions of contact with the saddle. Alternatively the two ends of a cable can be joined so that they both cross the saddle along one path.

The present applicant also found that vibrations of tailpiece components were also significantly reduced by providing that the single cable extends at least 10% of the distance between the bridge and the saddle before its division into individual cables for each string of the instrument. He found that a longer length of single cable significantly reduced vibrations that would otherwise occur if all the individual string cables extended all the way to the saddle. One embodiment of the present application creates a triangulation of the cables of the tailpiece as they extend toward the single cable that reduces vibration of the cables, reducing or eliminating noise that degrades the sound of the instrument.

The damping introduced in one embodiment of the present application also reduces vibration of strings and cables in the tailpiece area. Damping may be provided by a material woven between the cables of the tailpiece, such as string, yarn, rubber, foam, plastic or any other material that damps the vibrating of the tailpiece cables. Damping may also be provided by such a material attached to the cables of the tailpiece. The damping material can be in any shape, such as a sheet of material.

Cable tailpiece 12 includes several components between the attachment 4 to each string 1 and attachment to endpin 10, as shown in FIG. 1. A single end of tailpiece cable 9 attaches to endpin 10 of the instrument by looping over endpin 10. This cable loop then combines to single cable 7 which passes over the instrument's saddle 8. Copper crimp connector 13 can be used to form the loop. After single cable 7 passes over saddle 8 it then splits into separate cables 11 which attach to the instrument's strings 1. In one embodiment, the separate cables 11 are braided together to form single cable 7. A copper crimp 6 can be used at the location where separate cables 11 merge into single cable 7. The tailpiece's separate cables 11 may be constructed of a metal such as steel or they may be constructed of a synthetic polymer material such as nylon or a composite such as Kevlar. Separate cables 11 are sized to minimize weight and are strong enough to hold the tension of the instrument's strings 1. In addition, separate cables 11 are dampened by weaving a flexible damping material 5 between them such as yarn, rubber, foam or plastic material.

Figure 6:
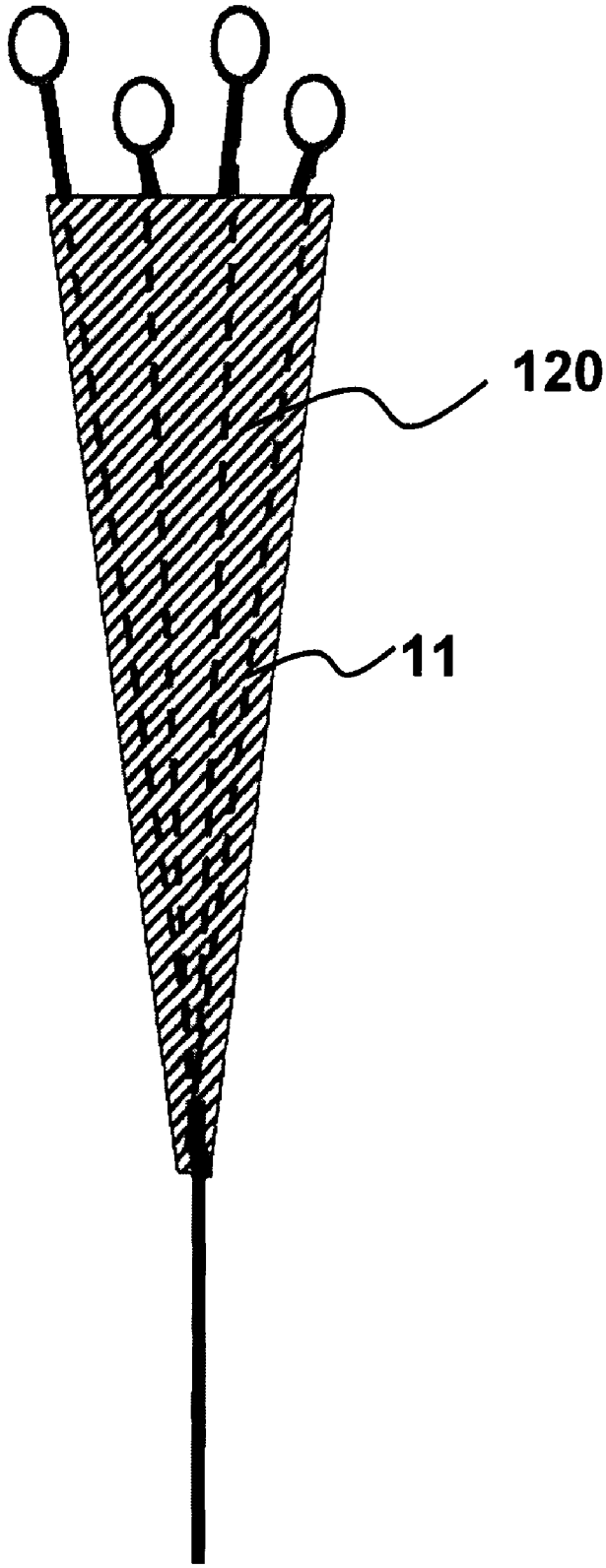
FIG. 6 is a top view of one embodiment illustrating sheets of damping material adhesively attached to each other and to the multiple separate cables.

In one embodiment a sheet of material can also be used for damping material 5. In one embodiment, two sheets of damping material 120, each with adhesive on one side are adhesively attached to each other and to cables 11, as shown in FIG. 6.

In one embodiment the cables are formed from the instrument strings themselves by extending those strings as if they themselves are the cables. In this case attachment 4 would be eliminated in FIG. 1. In this case the strings can be connected to each other to form the single cable that extends over the instrument's saddle along one path. Alternatively the strings can connect to a single cable that exclusively extends over the instrument's saddle along one path. Damping can be provided to the strings on the saddle side of the bridge as described herein.

Figure 4:
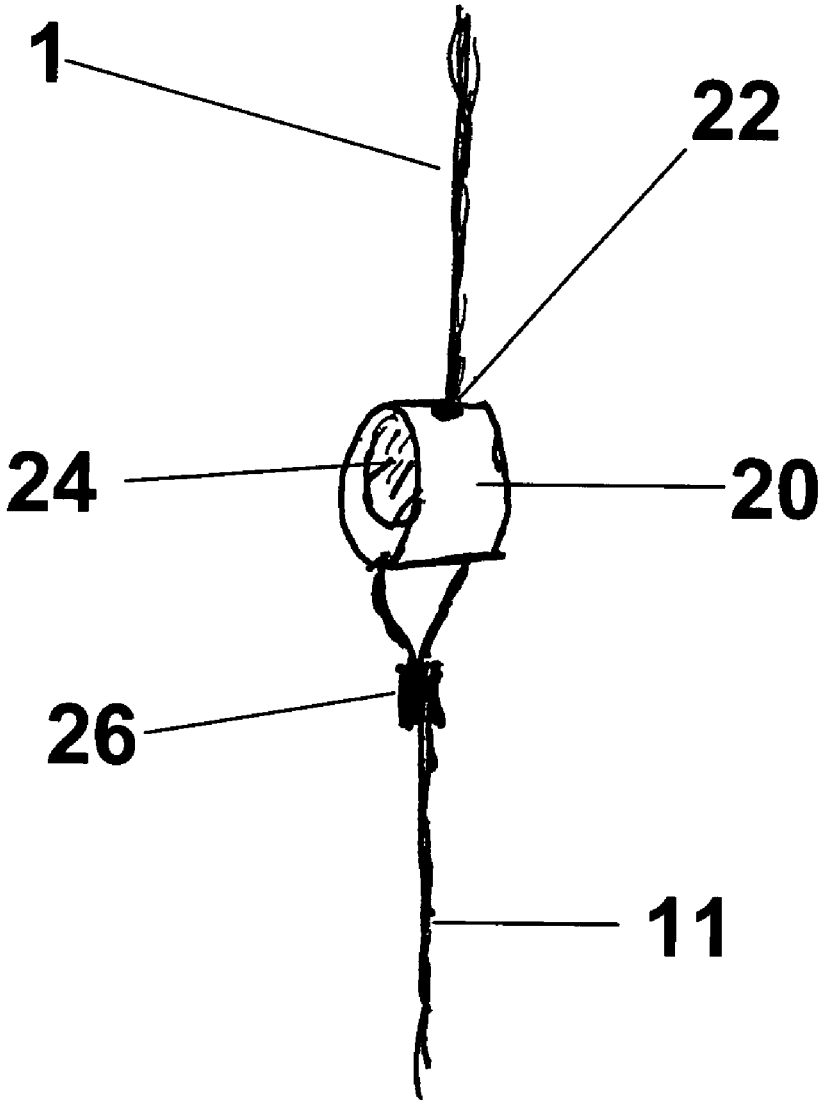
FIG. 4 is a three dimensional view of one embodiment of an attachment mechanism that attaches cables and strings.

The location of the point where single cable 7 separates into separate cables 11 is preferably at least 10 percent of the distance between saddle 8 and top 15 of bridge 3. Separate cables 11 are attached to strings 1 at close to the same location that the strings would attach to a traditional tailpiece. This attachment 4 uses a short cross section of brass tubing 20 for each string 1 with a hole 22 drilled through brass tubing 20. String 1 is usually manufactured with a ball 24 at its end, and ball 24 is inserted through this hole 22 in such a way as to allow this ball 24 to be held against the hole 22 inside brass tubing 20, as shown in FIG. 4. The string then extends from hole 22 over bridge 3 to a peg box (not shown). Separate cable 11 of tailpiece 12 is looped through brass tubing 20 and connected with copper crimp connector 26. Damping material 5 is woven between separate cables 11 with enough tension to dampen any cable vibrations but not enough to deflect the run of these separate cables.

Figure 3:
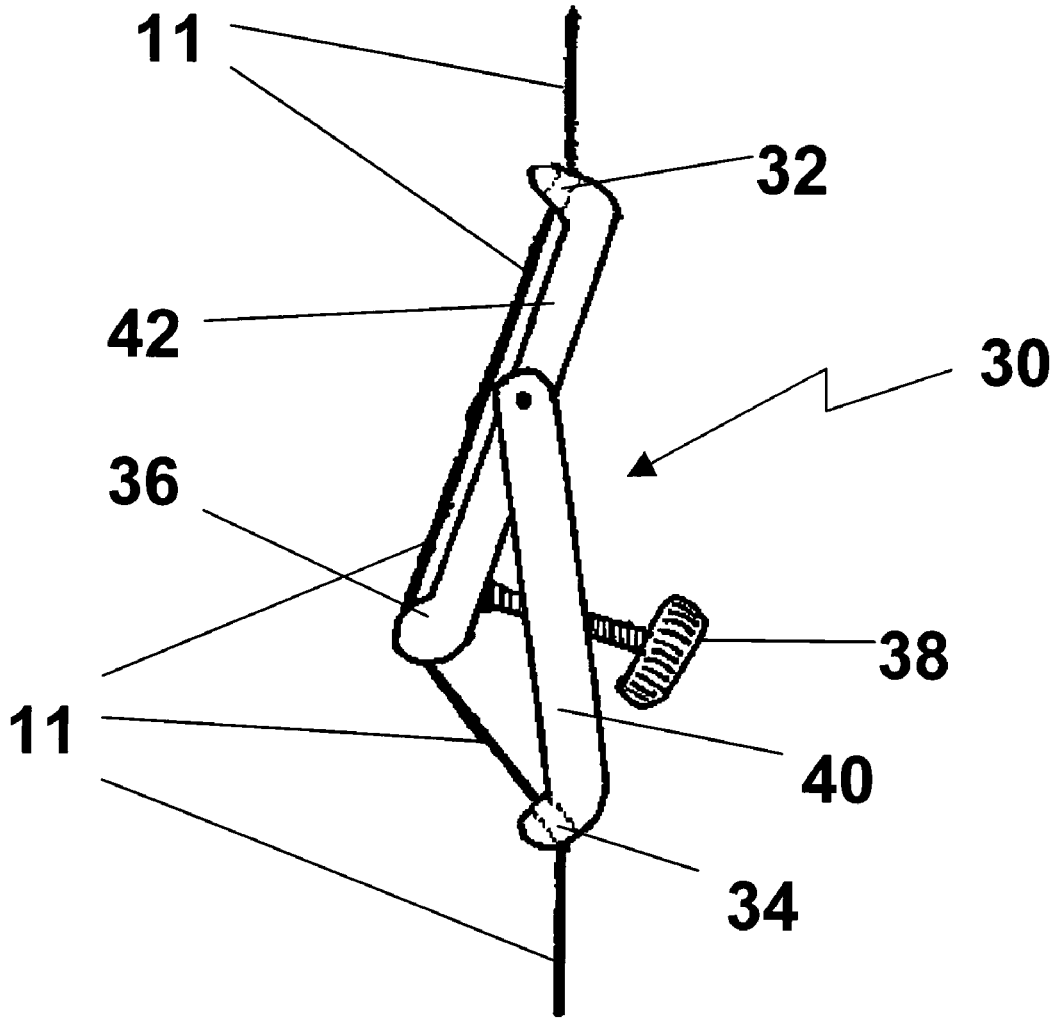
FIG. 3 is a side view of one embodiment of a pitch adjuster for adjusting length of a cable.

To meet the need for fine tuning of this instrument's pitch, adjusters 30 are provided that lengthen or shorten each tailpiece separate cable 11, as shown in FIG. 3. Separate cable 11 extends through holes 32, 34 and rests on region 36 of adjuster 30. Screw 38 is threaded through portion 40 and pushes on portion 42 of adjuster 30, bending separate cable 11 to adjust the tension in separate cable 11 and the musical pitch of the attached string.

Figure 5A:
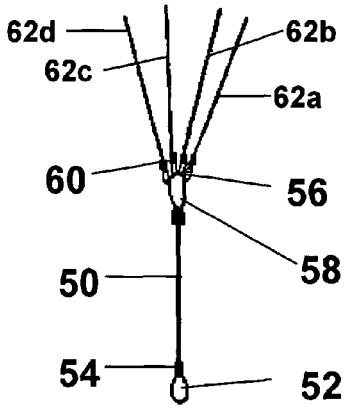
FIGS. 5*a*-5*c* are top views of different embodiments for joining multiple separate cables into a single cable.
Figure 5D:
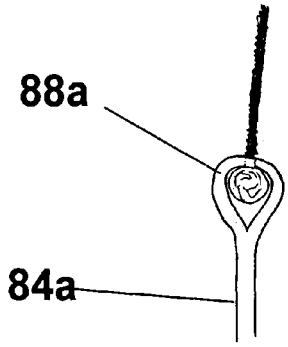
FIG. 5*d* is an enlarged view of one portion of FIG. 5*c;*
Figure 5C:
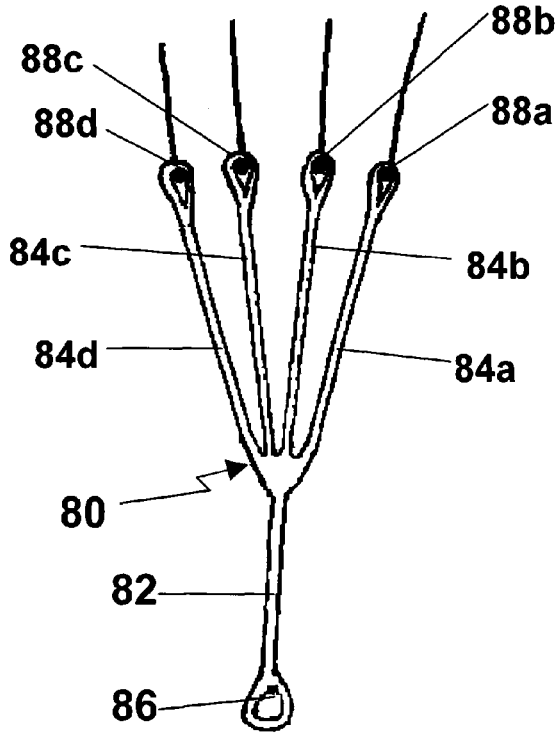
Figure 5B:
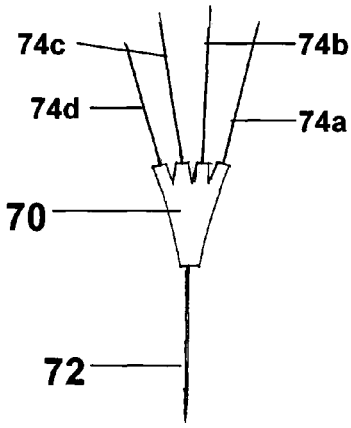

Different schemes for joining multiple separate cables 11 into single cable 7 are shown in FIGS. 5*a*, 5*b*, and 5*c*. Single cable 50 includes loop 52 with crimp 54 for extending around endpin 10, as shown in FIG. 5*a*. Single cable 50 also includes loop 56 with crimp 58 to which loops 60 of separate cables 62*a*-62*d* are connected.

Molded aluminum block connector 70 can be crimped for connecting single cable 72 and for connecting separate cables 74*a*-74*d*, as shown in FIG. 5*b*.

Molded connector 80 includes a unitary piece in which single cable 82 and separate cables 84*a*-84*d* are integrated, as shown in FIG. 5*c*. This unitary piece may be molded of a polymer or composite material, such as nylon or Kevlar. Loops 86 and 88*a*-88*d* may be formed in this unitary piece with the same molding. Loop 86 is sized so it can extend over the endpin 10. Loops 88*a*-88*d* are sized to hold the ball at the end of standard strings, as shown in FIG. 5*d*. Adjusters 30 can be used with each separate cable 84*a*-84*d*, and damping material 5, 120 can also be provided to separate cables 84*a*-84*d* as described herein above.

Figure 7:
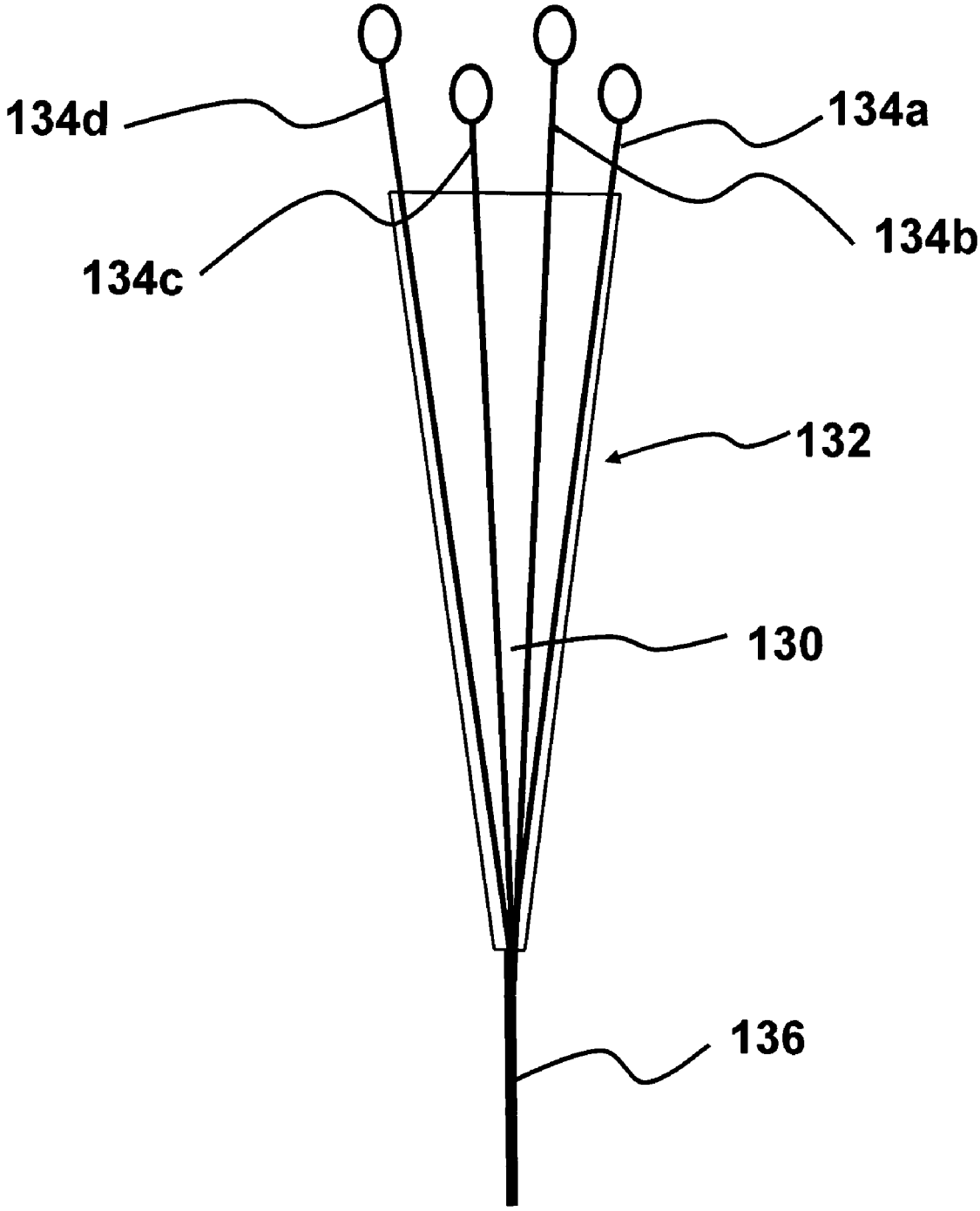
FIG. 7 is a top view of another embodiment illustrating a unitary structure including damping material integrated with multiple separate cables and a single cable.

In one embodiment damping material 130 is included in one unitary structure 132, as shown in FIG. 7. In this embodiment, separate cables 134*a*-134*d*, damping sheet material 130, and single cable 136 are integrated in one unitary structure 132 that may be molded from a material such as nylon or a composite. Damping sheet material 130 provides substantial damping to vibration while the light weight of unitary structure 132 avoids the muting effect, and single cable end 136 crossing the saddle allows the bridge of the instrument to more freely vibrate.

In one embodiment the string connection mechanism has a weight that is about equal to weight strings would have that extend from the bridge to the saddle.

In one embodiment an elastic mechanism on the tailpiece side of the bridge has an elasticity that is about equal to elasticity of strings on the other side of the bridge.

While several embodiments, together with modifications thereof, have been described in detail herein and illustrated in the accompanying drawings, it will be evident that various further modifications are possible without departing from the scope of the invention as defined in the appended claims. Nothing in the above specification is intended to limit the invention more narrowly than the appended claims. The examples given are intended only to be illustrative rather than exclusive.

| Term | Definition |
|---|---|
| Cable | Singe or multi-stranded wire or rope made from metal or synthetic material |
| Tailpiece | A component of a violin family string instrument used to attach the strings to the lower body of the instrument. It fits between the bridge and saddle and is attached to the instrument's endpin. The traditional tailpiece is made of wood. |
| Endpin | A component of the violin family of instruments which is fitted into a hole in the bottom of the instrument. With cellos and basses the endpin is used to hold the instrument off of the floor and to hold the tailpiece. With violins and violas the endpin's primary purpose is to hold the tailpiece. |
| Saddle | A wood block installed in the lower corner of the instrument over which a cable or wire passes to connect the instrument's tailpiece to the endpin. |
| Strings | The primary sound producers of a violin family instrument. Attached to the tailpiece, pass over the bridge and wrapped around the pegs at the top of the instrument's neck. A violin family instrument typical has 4 strings but can have as many as 6. |
| Bridge | A wooden structure normally made of maple over which the string passes. The bridge transfers the vibrations of the string to the instruments top table and body which amplify the string vibrations. |
| Damping agent | A flexible yarn, plastic or rubber material used to prevent unwanted vibrations of the cables in the cable tailpiece. |
| Violin family | Acoustical string instruments which include the violin, viola, cello and double bass. |

The invention claimed is:

1. A musical instrument comprising a body, a bridge, a plurality of strings, a string connection mechanism, and a saddle, and a single cable, wherein said bridge has a first side and a second side, wherein said plurality of strings extend across said bridge, wherein said plurality of strings is for vibrating on said first side, wherein said string connection mechanism is located on said second side, wherein said string connection mechanism joins all strings extending across said bridge to said single cable, wherein said single cable extends toward a single point between said string connection mechanism and said saddle, wherein said single cable connects to said string connection mechanism exclusively at one location, wherein said single cable tensions said strings.

2. A musical instrument as recited in claim 1, further comprising a damping material, wherein said damping material is located on said second side to dampen vibration of said strings on said second side.

3. A musical instrument as recited in claim 2, wherein said damping material includes at least one from the group including string, felt, foam, a rubber material, a plastic, and yarn.

4. A musical instrument as recited in claim 1, wherein said string connection mechanism has a weight that is about equal to weight of strings extending from said bridge to said saddle.

5. A musical instrument as recited in claim 1, wherein said string connection mechanism includes a plurality of separate cables and a joining mechanism, wherein said joining mechanism joins said plurality of separate cables into said single cable.

6. A musical instrument as recited in claim 5, wherein said joining mechanism includes braiding said plurality of separate cables, wherein said braiding provides said single cable.

7. A musical instrument as recited in claim 5, wherein said joining mechanism includes a connector.

8. A musical instrument as recited in claim 5, wherein said plurality of separate cables are strings that connect to said single cable.

9. A musical instrument as recited in claim 1, further comprising a single unitary piece, wherein said string connection mechanism includes a plurality of cables and a connector, wherein said connector joins said plurality of separate cables into said single cable, wherein said connector, said plurality of separate cables and said single cable are integrated in said single unitary piece.

10. A musical instrument as recited in claim 9, wherein said single unitary piece includes a molded material.

11. A musical instrument as recited in claim 9, wherein said single unitary piece includes one from the group consisting of nylon and a composite material.

12. A musical instrument as recited in claim 9, wherein said single unitary piece provides vibration damping.

13. A musical instrument as recited in claim 1, further comprising an endpin, wherein said single cable extends over said saddle to said endpin, wherein said endpin connects said single cable to said body.

14. A musical instrument as recited in claim 1, wherein said bridge is located a distance from said saddle, wherein said single cable extends at least 10% of said distance.

15. A musical instrument as recited in claim 1, further comprising a fine tuner.

16. A musical instrument as recited in claim 15, wherein said fine tuner includes a tension adjusting mechanism.

17. A musical instrument as recited in claim 16, wherein tension adjusting mechanism includes a screw.

18. A musical instrument as recited in claim 17, wherein tension adjusting mechanism includes a first portion and a second portion, wherein said screw extends through said first portion and pushes on said second portion for adjusting tension in said cable.

19. A musical instrument as recited in claim 1, wherein said musical instrument includes one from the group consisting of a violin, a viola, a cello, and a bass.

20. A musical instrument as recited in claim 1, wherein said single cable extends over said saddle at only one location.

21. A musical instrument comprising a body, a bridge, a plurality of strings, a string connection mechanism, a saddle, and a cable, wherein said bridge has a first side and a second side, wherein said plurality of strings extend across said bridge, wherein said plurality of strings is for vibrating on said first side, wherein said string connection mechanism is located on said second side, wherein said string connection mechanism connects to all strings extending across said bridge, wherein said string connection mechanism extends toward a single point between said bridge and said saddle, wherein said cable extends between said single point and said saddle, wherein said cable tensions said strings.

22. A musical instrument as recited in claim 21, wherein said cable is a single cable, wherein said string connection mechanism includes a plurality of separate cables and a joining mechanism, wherein said joining mechanism joins said plurality of separate cables into said single cable.

23. A musical instrument as recited in claim 22, wherein said joining mechanism includes braiding said plurality of separate cables, wherein said braiding provides said single cable.

24. A musical instrument as recited in claim 22, wherein said joining mechanism includes a connector.

25. A musical instrument as recited in claim 22, wherein said single cable extends over said saddle at only one location.

26. A musical instrument as recited in claim 22, further comprising a single unitary piece, wherein said string connection mechanism includes a plurality of cables and a connector, wherein said connector joins said plurality of separate cables into said single cable, wherein said connector, said plurality of separate cables and said single cable are integrated in said single unitary piece.

27. A musical instrument as recited in claim 26, wherein said single unitary piece includes a molded material.

28. A musical instrument as recited in claim 26, wherein said single unitary piece provides vibration damping.

29. A musical instrument as recited in claim 22, wherein said bridge is located a distance from said saddle, wherein said single cable extends at least 10% of said distance.

30. A musical instrument as recited in claim 22, wherein said plurality of separate cables are strings that connect to said single cable.

31. A musical instrument as recited in claim 21, further comprising a damping material, wherein said damping material is located on said second side to dampen vibration of said strings on said second side.

32. A musical instrument as recited in claim 31, wherein said damping material includes at least one from the group including string, felt, foam, a rubber material, a plastic, and yarn.

33. A musical instrument as recited in claim 21, wherein said string connection mechanism has a weight that is about equal to weight of strings extending from said bridge to said saddle.

34. A musical instrument as recited in claim 21, further comprising a fine tuner.

35. A musical instrument as recited in claim 21, wherein said musical instrument includes one from the group consisting of a violin, a viola, a cello, and a bass.

36. A musical instrument comprising a body, a bridge, a plurality of strings, a string connection mechanism, and a saddle, wherein said bridge has a first side and a second side, wherein said plurality of strings extends across said bridge, wherein said plurality of strings is for vibrating on said first side, wherein said string connection mechanism is located on said second side, wherein said string connection mechanism is for connecting said plurality of strings to said body, wherein said string connection mechanism consists of a connector and a cable, wherein said connector connects all strings extending across said bridge to said cable, wherein said cable extends over said saddle at only one location, wherein said cable tensions said strings.

* * * * *